US008311444B2

(12) United States Patent
Okamoto et al.

(10) Patent No.: US 8,311,444 B2
(45) Date of Patent: Nov. 13, 2012

(54) CLEANING DEVICE AND IMAGE FORMING APPARATUS THAT REMOVE RESIDUAL TONER FROM AN INTERMEDIATE TRANSFER BELT

(75) Inventors: Sueaki Okamoto, Osaka (JP); Kouji Uno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 388 days.

(21) Appl. No.: 12/707,370

(22) Filed: Feb. 17, 2010

(65) Prior Publication Data

US 2010/0272464 A1 Oct. 28, 2010

(30) Foreign Application Priority Data

Apr. 24, 2009 (JP) ..... 2009-106017

(51) Int. Cl.
*G03G 15/16* (2006.01)

(52) U.S. Cl. ..... 399/101

(58) Field of Classification Search ..... 399/101, 399/297, 302, 308

See application file for complete search history.

(56) References Cited

U.S. PATENT DOCUMENTS

| | | | | |
|---|---|---|---|---|
| 5,579,096 | A * | 11/1996 | Saito et al. | 399/101 |
| 7,519,309 | B2 * | 4/2009 | Miyamoto et al. | 399/101 |
| 7,668,480 | B2 * | 2/2010 | Nakayama et al. | 399/101 |
| 7,903,995 | B2 * | 3/2011 | Nakamatsu et al. | 399/101 |

FOREIGN PATENT DOCUMENTS

JP 2005-258167 9/2005

* cited by examiner

*Primary Examiner* — William J Royer
(74) *Attorney, Agent, or Firm* — Frommer Lawrence & Haug LLP

(57) ABSTRACT

A cleaning device may include a cleaning member, a toner recovery roller, a scraping member, and a supporting member. The cleaning member may rotate so as to remove residual toner from an intermediate transfer belt looped between multiple rollers. In some embodiments, a toner recovery roller may electrically recover the toner from the cleaning member. Some embodiments include a scraping member in contact with the cleaning member at a downstream side, in a rotating direction of the cleaning member, relative to a cleaning nip section where the intermediate transfer belt and the cleaning member are in contact with each other and at an upstream side, in the rotating direction of the cleaning member, relative to a recovery nip section where the cleaning member and the toner recovery roller are in contact with each other. The supporting member may be configured to fix a relative position between the toner recovery roller and the cleaning member and support the scraping member.

13 Claims, 4 Drawing Sheets

CLEANING DEVICE AND IMAGE FORMING APPARATUS THAT REMOVE RESIDUAL TONER FROM AN INTERMEDIATE TRANSFER BELT

INCORPORATION BY REFERENCE

This application is based upon and claims the benefit of priority from the corresponding Japanese Patent application No. 2009-106017, filed Apr. 24, 2009, the entire content of which is incorporated herein by reference.

FIELD OF THE INVENTION

The present invention relates to a cleaning device fitted to an image forming apparatus, such as a copier, a printer, a facsimile apparatus, or a multifunction apparatus equipped with these multiple functions.

BACKGROUND OF THE INVENTION

An image forming apparatus of the related art, such as a copier, a printer, a facsimile apparatus, or a multifunction apparatus equipped with these multiple functions, contains a cleaning device including a cleaning member that rotates so as to remove residual toner from an intermediate transfer belt looped between multiple rollers and a toner recovery roller that electrically recovers the toner from the cleaning member.

The cleaning device is configured to wipe off and remove, at a downstream side relative to a secondary transfer unit as viewed in a rotating direction of the intermediate transfer belt, residual toner remaining on the surface of the intermediate transfer belt after a toner image primarily transferred on the intermediate transfer belt from an electrophotographic photosensitive body is secondarily transferred onto transfer paper. The residual toner remaining on the surface of the intermediate transfer belt is collected between brush fibers of the cleaning member made of a roller-shaped fur brush by rotating the cleaning member in a counter direction of the rotating direction of the intermediate transfer belt. Subsequently, the residual toner collected between the brush fibers is electrostatically recovered by applying a bias to the toner recovery roller that is in contact with the cleaning member in an engaged manner. In detail, the tension of the intermediate transfer belt looped between at least two rollers (e.g., a driving roller and a driven roller) is maintained by using the driven roller or another roller as a tension roller, and the fur brush serving as the cleaning member is disposed so as to face this tension roller across the intermediate transfer belt.

In this case, the tension roller and the fur brush form a cleaning area by bringing the outer periphery of a first holding member rotatably holding the fur brush and the outer periphery of a second holding member rotatably holding the tension roller into contact with each other.

Regarding the toner recovery roller that electrically recovers the toner from the fur brush, a bearing portion of the toner recovery roller and a bearing portion of the fur brush are integrally formed with a single component, and the fur brush is made rotatable about the bearing portion of the toner recovery roller.

If the tension roller is made rotationally displaceable so as to apply tension to the intermediate transfer belt, the tension applied by the tension roller to the intermediate transfer belt may be set greater than the pressure applied by the fur brush to the intermediate transfer belt so that if the tension roller is installed in a plurality, the fur brush can be attached to any one of the tension rollers.

In the aforementioned cleaning device, the bearing portion of the fur brush and the bearing portion of the toner recovery roller are integrally formed with a single component and the fur brush is made rotatable about the bearing portion of the toner recovery roller, and the cleaning area is formed by bringing the outer periphery of the first holding member rotatably holding the fur brush and the outer periphery of the second holding member rotatably holding the tension roller into contact with each other. In this case, if the amount of displacement of the tension roller becomes large due to, for example, a variation in the inner perimeter of the intermediate transfer belt or a variation in the bias load of the tension roller, a rotational displacement amount of the fur brush that is rotationally displaceable around the bearing portion of the toner recovery roller would also become large. Therefore, if a cleaning case that supports the fur brush, the toner recovery roller, and the like is fixed within a main body of the image forming apparatus, the fur brush may possibly rotationally move in a direction that causes a gap between the cleaning case and the brush surface of the fur brush to increase.

When the gap between the cleaning case and the brush surface of the fur brush increases, toner accumulating inside the cleaning case with the rotation of the fur brush may unfavorably splatter outward of the cleaning case or spill from an opening of the cleaning case.

Conceivable techniques for enhancing cleaning performance using a fur brush include, for example, optimizing brush conditions, such as brush elasticity, brush fineness (thickness), brush density, and brush resistance value, or changing conditions by increasing a bias potential applied to the toner recovery roller so as to increase a bias potential difference between the fur brush and the toner recovery roller. However, when the gap between the cleaning case and the brush surface of the fur brush increases, simply changing these various conditions is not sufficient because clogging may tend to occur readily in the brush, depending on a set amount by which the toner recovery roller engages into the fur brush, and the fur brush may contract and decrease in outer diameter. This can lead to a problem of deteriorated cleanability at cleaning sections (i.e., a contact section between the fur brush and the intermediate transfer belt and an engagement section between the fur brush and the cleaning member).

Furthermore, although increasing the amount by which the toner recovery roller engages into the fur brush enhances recovery performance of the toner recovery roller in addition to enhancing cleanability and exhibiting a toner-spillage reduction effect, an increase in torque in the fur brush may occur readily.

When an idling period (stopped period) in which an image forming process is not performed is long, the brush fibers of the fur brush may become deformed and stay in a flattened state, resulting in problems such as defective cleaning and speed variation caused by torque fluctuation.

In addition, when the amount of displacement of the tension roller becomes large as mentioned above, if a blade member, which is for scraping off the toner and is in contact with the fur brush at an upstream side, in the rotating direction, relative to an engagement position of the toner recovery roller, is provided, the amount of engagement between the blade member and the fur brush would deviate from a predetermined amount, resulting in a difficulty in maintaining stable cleaning performance.

SUMMARY OF THE INVENTION

In some embodiments, a cleaning device may include a cleaning member, a toner recovery roller, and a scraping member. The cleaning member may rotate so as to remove residual toner from an intermediate transfer belt looped between multiple rollers. Some embodiments may include a toner recovery roller that electrically recovers the toner from the cleaning member. In various embodiments, a scraping member may be in contact with the cleaning member at a downstream side, in a rotating direction of the cleaning member, relative to a cleaning nip section, where the intermediate transfer belt and the cleaning member are in contact with each other, and at an upstream side, in the rotating direction of the cleaning member, relative to a recovery nip section, where the cleaning member and the toner recovery roller are in contact with each other. The cleaning device may further include a supporting member that is configured to fix a relative position between the toner recovery roller and the cleaning member and support the scraping member. The cleaning device may be configured such that an amount by which the toner recovery roller engages into the cleaning member during image formation is substantially equal to or smaller than an amount by which the scraping member engages into the cleaning member. The cleaning device may further include a driving mechanism configured to move the scraping member so that an amount by which the scraping member engages into the cleaning member differs between an image formation mode and an image-formation stopped mode.

In some embodiments, an image forming apparatus may include an electrophotographic photosensitive body, a charging unit, an exposure unit, a developing unit, an intermediate transfer belt looped between multiple rollers, a transfer unit, a cleaning member, a toner recovery roller, and/or a scraping member. In some embodiments, a charging unit may charge the electrophotographic photosensitive body. An exposure unit may expose the electrophotographic photosensitive body charged by the charging unit to light such that an electrostatic latent image is formed on the electrophotographic photosensitive body. An embodiment of a developing unit may include a developer to develop the electrostatic latent image formed on the electrophotographic photosensitive body by the exposure unit so as to form a developer image on the electrophotographic photosensitive body. In some embodiments, the developer image on the electrophotographic photosensitive body may be transferred to an intermediate transfer belt looped between multiple rollers (e.g., primary transfer). In various embodiments, a transfer unit may transfer the developer image on the intermediate transfer belt onto a predetermined recording medium (e.g., secondary transfer). In some embodiments, a cleaning member may rotate in a manner to remove residual developer from the intermediate transfer belt. An embodiment may include a toner recovery roller that electrically recovers the developer from the cleaning member. Some embodiments may include a scraping member that is in contact with the cleaning member at a downstream side, in a rotating direction of the cleaning member, relative to a cleaning nip section and at an upstream side, in the rotating direction of the cleaning member, relative to a recovery nip section. The cleaning nip section may be defined as the section where the intermediate transfer belt and the cleaning member are in contact with each other. The recovery nip section may be defined as the section where the cleaning member and the toner recovery roller are in contact with each other. The image forming apparatus may be configured such that an amount by which the toner recovery roller engages into the cleaning member during image formation is substantially equal to or smaller than an amount by which the scraping member engages into the cleaning member.

The above and other objects, features, and advantages of the present invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents. Embodiments of the present invention will now be described in detail according to constitutional features.

An example in which a cleaning device is applied to a full-color printer serving as an image forming apparatus will now be described with reference to the drawings. Although embodiments to be described below are suitable specific examples with respect to the cleaning device and may sometimes be given various technical limitations, the technical scope of the invention is not to be limited to these embodiments unless there is a description that particularly limits the invention.

Figure 1:
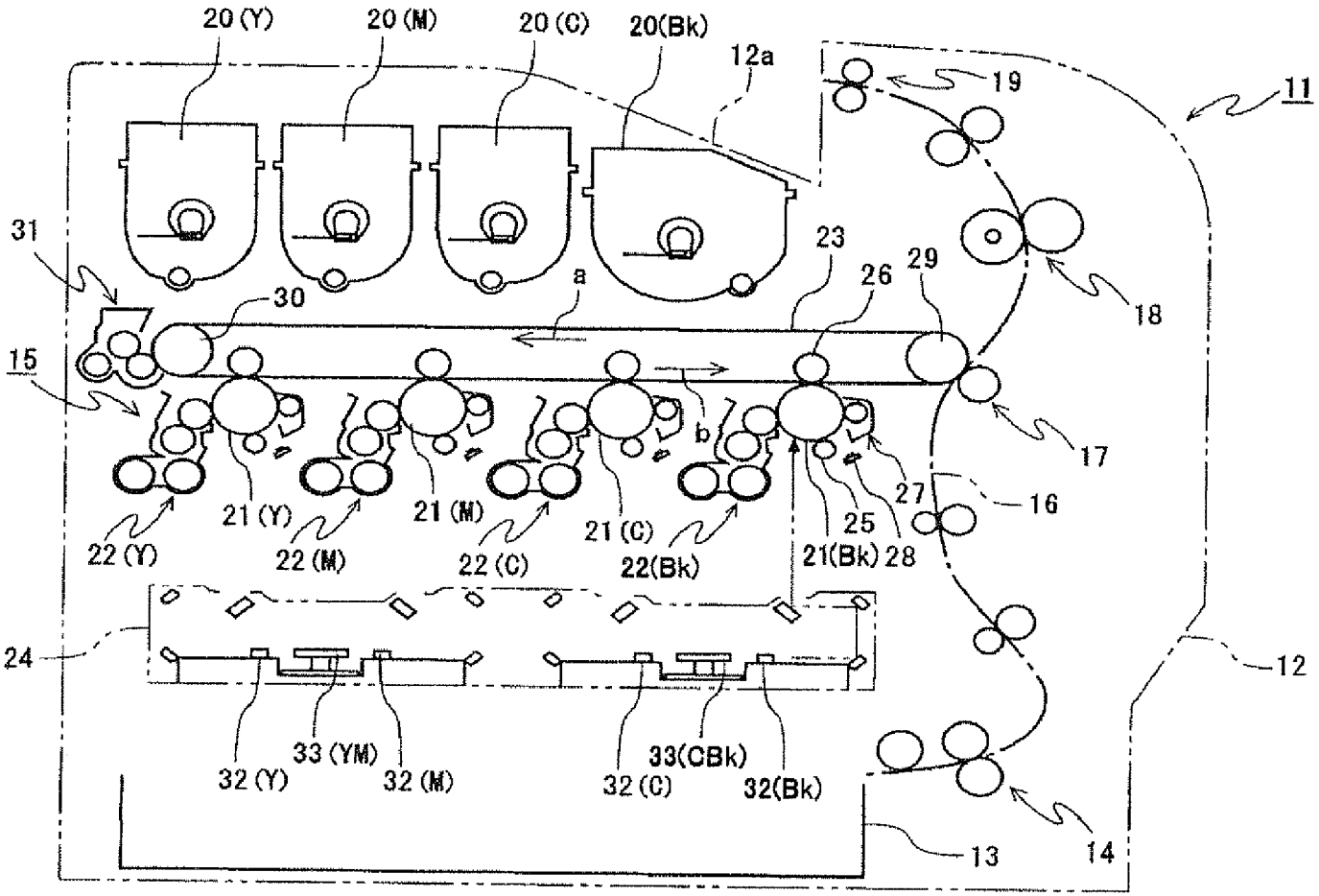
FIG. 1 illustrates an embodiment of an image forming apparatus including a cleaning device.
Figure 2:
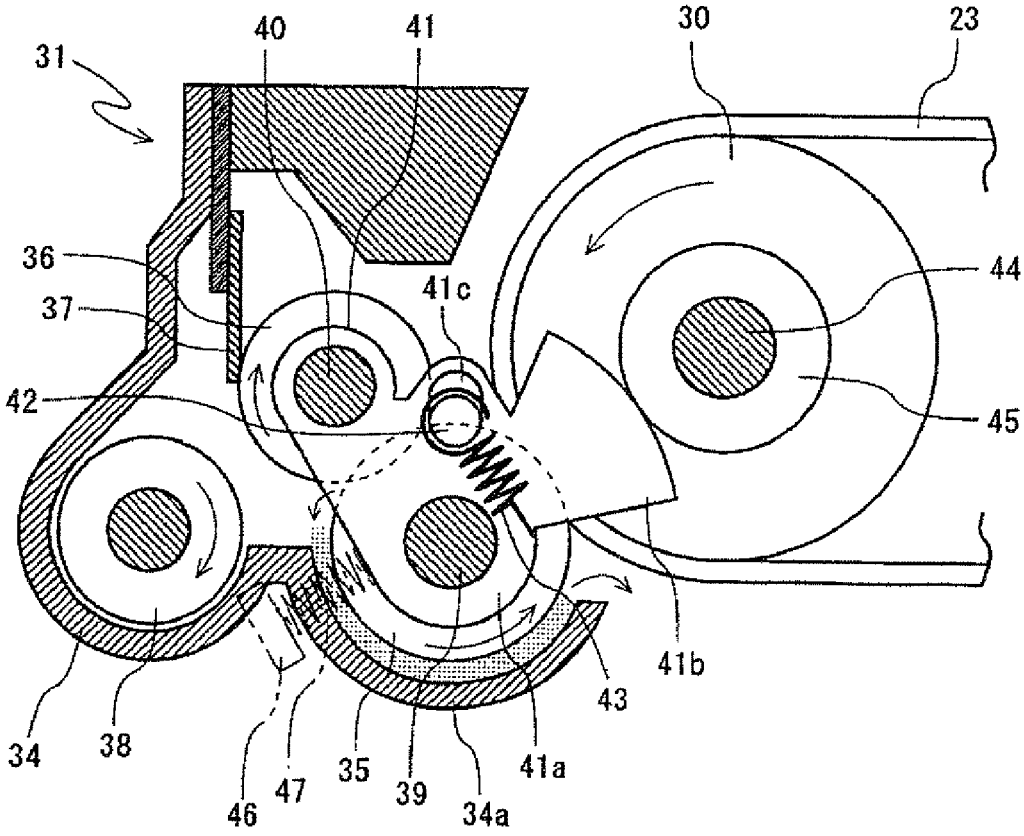
FIG. 2 illustrates a part of a cleaning device according to an embodiment.

FIG. 1 illustrates an image forming apparatus which includes a cleaning device. FIG. 2 illustrates a part of a cleaning device.

As shown in FIG. 1, tandem color printer 11 may serve as the image forming apparatus which includes the cleaning device. An embodiment may include an image forming apparatus having printer body 12. In some embodiments, as shown in FIG. 1 printer body 12 may include paper feed cassette 13, feeder 14, image formation processor 15, secondary transfer unit 17, fixing unit 18, and ejecting unit 19. In some embodiments, paper feed cassette 13 may accommodate transfer paper (not shown). Feeder 14 may remove transfer paper from paper feed cassette 13 in embodiments. Various embodiments may include image formation processor 15 that performs an image forming process on transfer paper fed from paper feed cassette 13 or a manual feed tray (not shown). In an embodiment, secondary transfer unit 17 may transfer a toner image formed as a result of the image forming process in image formation processor 15 onto the transfer paper fed from paper feed cassette 13 or the manual feed tray while guiding the transfer paper along transfer-paper conveying path 16. Various embodiments may include fixing unit 18 that fixes the transferred toner image onto the transfer paper. Embodiments may include ejecting unit 19 that ejects the transfer paper having undergone the fixing process.

In some embodiments, image formation processor 15 employs a tandem method in which an image forming process is performed by using, for example, toners (developers) of four colors, namely, yellow (Y), magenta (M), cyan (C), and black (Bk). Various embodiments may include fewer or more colors. In addition, the colors may include a broad range of colors beyond the colors listed here. In the following description, each component will be given a reference numeral with a color or colors (Y, M, C, and/or Bk) in parentheses after the numeral when designating a particular color or colors, or will only be given a reference numeral when the component is used in common among the colors.

As shown in FIG. 1, image formation processor 15 may include multiple toner containers 20, multiple photosensitive drums 21, and multiple developing units 22 designated for each of the respective colors (Y, M, C, and Bk). In addition, image formation processor 15 may include endless intermediate transfer belt 23. As shown in FIG. 1, toner containers 20 may hold toners for supply. In some embodiments, photosensitive drums 21 each may serve as an amorphous-silicon electrophotographic photosensitive body that forms a toner image from a toner of the corresponding color on the basis of image data included in print data sent from a personal computer (not shown). In various embodiments, multiple developing units 22 supply toners to photosensitive drums 21. An embodiment may include endless intermediate transfer belt 23 onto which the toner image formed on each photosensitive drum 21 is transferred.

In some embodiments, photosensitive drums 21 are configured to bear toner images of the respective colors on the surfaces thereof on the basis of light beams emitted from exposure unit 24. Photosensitive drums 21 may be used to primarily transfer the toner images onto intermediate transfer belt 23 in some embodiments. As shown in FIG. 1, in some embodiments, photosensitive drums 21 are disposed below intermediate transfer belt 23 together with developing units 22. FIG. 1 depicts each of photosensitive drums 21 surrounded by charging unit (charging roller) 25, exposure unit 24, the corresponding developing unit 22, transfer roller 26, photosensitive cleaning device 27, and charge remover 28 that are arranged in the order in which the transferring process is performed.

In some embodiments, developing units 22 basically have the same configuration and are arranged side-by-side below intermediate transfer belt 23 along a rotating direction thereof. A detailed description of the configuration of developing units 22 will be omitted here.

As shown in FIG. 1, in some embodiments, intermediate transfer belt 23 may be an endless belt disposed so as to extend horizontally within printer body 12. Intermediate transfer belt 23 may be driven in a circulatory motion along with an image forming operation. A toner image primarily transferred on intermediate transfer belt 23 is secondarily transferred by secondary transfer unit 17 onto transfer paper conveyed through transfer-paper conveying path 16 from paper feed cassette 13 or the manual feed tray. In some embodiments, intermediate transfer belt 23 is rotatably looped between two rollers 29 and 30, and the tension thereof is maintained by setting one roller 29 as a driving roller and the other roller 30 as a driven roller serving also as a tension roller. On one side of intermediate transfer belt 23 cleaning device 31 is provided. In some embodiments, a position of the cleaning device 31 may vary. Various embodiments may include multiple cleaning devices 31. In some embodiments, cleaning device 31 may remove residual toner from intermediate transfer belt 23, after intermediate transfer belt 23 transfers a toner image onto transfer paper in secondary transfer unit 17, from the surface of intermediate transfer belt 23.

In some embodiments, transfer paper with the toner image transferred thereon in secondary transfer unit 17 travels through transfer-paper conveying path 16 so as to reach fixing unit 18 where the toner image is fixed onto the transfer paper. Subsequently, the transfer paper is guided to ejecting unit 19 disposed at the terminal end of transfer-paper conveying path 16 so as to be ejected and stacked on paper output tray 12*a* serving also as an upper surface of printer body 12. A tension mechanism of roller 30 is of a known type and is displaceable in the rotating direction (i.e., a direction indicated by arrows a and b) of intermediate transfer belt 23 so as to maintain the tension of intermediate transfer belt 23.

As shown in FIG. 1, exposure unit 24 may include multiple light sources 32(Y, M, C, and Bk) corresponding to the respective photosensitive drums 21(Y, M, C, and Bk) and polarizing devices 33(YM) and 33(CBk), such as polygon mirrors. In some embodiments, as illustrated in FIG. 1, light sources 32(Y, M, C, and Bk) are divided into two pairs, namely, a pair of light sources 32(Y) and 32(M) and a pair of light sources 32(C) and 32(Bk). In some embodiments, polarizing device 33(YM) is shared by the pair of light sources 32(Y) and 32(M) and the polarizing device 33(CBk) is shared by the pair of light sources 32(C) and 32(Bk). An embodiment may include exposure unit 24 that uses the polarizing devices 33(YM) and 33(CBk) to polarize and scan light beams emitted from the light sources 32(Y, M, C, and Bk) while focusing the light beams on photosensitive drums 21(Y, M, C, and Bk) charged by charging units 25.

In some embodiments, cleaning device 31 extends in the width direction of intermediate transfer belt 23 (i.e., a direction orthogonal to the plane of the drawing in FIG. 1 or a width direction of transfer paper). In an embodiment, cleaning device 31 is disposed so as to face roller (tension roller) 30 across intermediate transfer belt 23. As shown in FIG. 2, cleaning device 31 includes cleaning case 34, cleaning member 35, toner recovery roller 36, cleaning blade 37, and a spiral 38. Various embodiments include cleaning member 35 formed of a roller-shaped fur brush that is in contact with the surface of intermediate transfer belt 23. Some embodiments, as shown in FIG. 2, may include toner recovery roller 36 that electrically recovers residual toner from cleaning member 35. Cleaning blade 37 may remove toner from toner recovery roller 36. For example, cleaning blade 37 may scrape off the residual toner recovered by toner recovery roller 36. Various embodiments may include spiral 38 that recovers and conveys the residual toner scraped off by cleaning blade 37.

As shown in FIG. 2, cleaning device 31 scrapes off and removes the residual toner and the like remaining on the surface of intermediate transfer belt 23 by rotating cleaning member 35 counter to the direction of the rotating intermediate transfer belt 23 (i.e., a direction indicated by an arrow in FIG. 2).

Residual toner scraped off intermediate transfer belt 23 by cleaning member 35 is recovered by toner recovery roller 36 in various embodiments. In some embodiments, this recovery is provided and/or assisted by an electrical potential difference between cleaning member 35 and toner recovery roller 36 due to an electrical bias applied to toner recovery roller 36.

Residual toner recovered by toner recovery roller 36 is scraped off by the cleaning blade 37 that is in contact with toner recovery roller 36 in the counter direction, and is ejected outward of the cleaning device 31 by spiral 38 disposed below cleaning blade 37 in some embodiments.

Various embodiments may include cleaning member 35 made of, for example, a fur brush composed of a conductive resin material, such as conductive polyester, conductive nylon, combinations of conductive polyester and conductive nylon, other materials known in the art or combinations thereof. In some embodiments, toner recovery roller 36 is made of for example, stainless steel, a nickel-plated metal, a combination of stainless steel and nickel-plated metal, other materials known in the art or combinations thereof. Embodiments may include cleaning blade 37 made of, for example, a polyurethane resin sheet or a polyethylene-terephthalate (PET) resin film. As depicted in FIG. 2, scraping member 42 may be made of a metallic rod-shaped member or plate-shaped member and may engage a brush roller serving as cleaning member 35. In some embodiments, a portion of a scraping member may overlap a portion of a brush roller by about 1 mm to about 1.5 mm.

As shown in FIG. 2, some embodiments may include supporting member 41 provided between an end of a rotary shaft 39 of the cleaning member 35 and an end of a rotary shaft 40 of the toner recovery roller 36, which fixes a relative position between cleaning member 35 and toner recovery roller 36.

As depicted in FIG. 2, supporting member 41 includes base portion 41*a* that rotatably supports rotary shafts 39 and 40, fan-shaped contact portion 41*b* that protrudes from an outer peripheral surface of base portion 41*a*, long hole 41*c* formed near an upper edge of cleaning member 35, rod-shaped scraping member 42 displaceably supported along long hole 41*c*, and spring 43 that mechanically biases scraping member 42 in a direction in which scraping member 42 engages into cleaning member 35.

As illustrated in FIG. 2, in some embodiments, contact portion 41*b* is fan-shaped so as to have a peripheral surface with a circular-arc shape centered on rotary shaft 39 of cleaning member 35. As shown, contact portion 41*b* is symmetrical with respect to an axis line that connects the center of rotation of rotary shaft 39 of cleaning member 35 and center of rotation of support shaft 44 of roller 30. In some embodiments, the circular-arc peripheral surface of contact portion 41*b* is in contact with collar 45 provided around support shaft 44 so as to allow cleaning member 35 to follow displacement of the roller 30, thereby maintaining (fixing) a relative distance between roller 30 and cleaning member 35. Embodiments may include contact portions having various geometries including, but not limited to arcs, circular arcs, bows, arches or any other geometry.

As depicted in FIG. 2, contact portion 41*b* is, for example, mechanically biased by bias member 47. A bias member may include any member capable of mechanically biasing the contact portion, including, but not limited to elastic members, such as coils, springs, coil springs or other materials known in the art. In some embodiments, bias member 47 may have one end supported by supporting member 46 such that another end is elastically in contact with base portion 41*a* at the rear side of contact portion 41*b*.

As shown in FIG. 2, at a recovery nip section toner recovery roller 36 engages cleaning member 35. In some embodiments, the elasticity of cleaning member 35 causes the residual toner to splatter downstream in the rotating direction and accumulate near an area below toner recovery roller 36 and between cleaning case 34 and cleaning member 35. Thus, as the toner accumulates between bottom 34*a* of cleaning case 34 and cleaning member 35, the toner may spill from an opening between bottom 34*a* of cleaning case 34 and cleaning member 35.

In some embodiments, scraping member 42 is disposed on the downstream side, in the rotating direction of cleaning member 35, relative to a cleaning nip section where intermediate transfer belt 23 and cleaning member 35 are in contact with each other. In some embodiments, scraping member 42 is disposed on the upstream side, in the rotating direction of cleaning member 35, relative to the recovery nip section between cleaning member 35 and toner recovery roller 36. In some embodiments, such as the embodiment shown in FIG. 2, scraping member 42 may be disposed both on the downstream side, in the rotating direction of cleaning member 35, relative to a cleaning nip section where intermediate transfer belt 23 and cleaning member 35 are in contact with each other; and on the upstream side, in the rotating direction of cleaning member 35, relative to the recovery nip section between cleaning member 35 and toner recovery roller 36.

In some embodiments, scraping member 42 is supported by supporting member 41 that supports the toner recovery roller 36 and the cleaning member 35. In various embodiments, scraping member 42 is rotated about the center of axis of toner recovery roller 36 by the same rotational amount as cleaning member 35, so that the amount of engagement between scraping member 42 and cleaning member 35 can be maintained constant. In some embodiments, an amount by which scraping member 42 engages into cleaning member 35 is set equal to or greater than the amount by which toner recovery roller 36 engages into cleaning member 35.

In some embodiments, when scraping member 42 engages cleaning member 35 by a greater amount relative to that of toner recovery roller 36, the toner located further inward towards the center of axis and between the brush fibers of cleaning member 35 can be scraped off.

In some embodiments, an amount of engagement between toner recovery roller 36 and cleaning member 35 can be set. The amount of engagement between the toner recovery roller 36 and the cleaning member 35 may be determined for recovering the residual toner inside cleaning member 35. For example, the amount of engagement between the toner recovery roller 36 and the cleaning member 35 can be set equal to or smaller than the amount by which scraping member 42 engages cleaning member 35, thereby decreasing defective toner recovery from cleaning member 35 and a toner spillage caused by splattering of the toner from cleaning member 35.

In various embodiments, toner spillage may be reduced and/or inhibited. For example, although contacting cleaning member 35 with scraping member 42 may splatter the residual toner towards the downstream side of scraping member 42 (i.e., the upstream side of the toner recovery roller 36), since the residual toner is electrically recovered due to the electrical bias applied to toner recovery roller 36, a toner spillage towards the downstream side of toner recovery roller 36 can be decreased.

In some embodiments, even when a large load that exceeds the bias force of spring 43 is applied to scraping member 42 due to a load from cleaning member 35, an increase in torque can be inhibited and/or prevented since scraping member 42 can be displaced along long hole 41*c* in a direction away from cleaning member 35.

Accordingly, cleanability can be ensured regardless of the amount of displacement of roller 30, and the amount of engagement between toner recovery roller 36 and cleaning member 35 can be controlled (e.g., reduced), thereby maintaining cleanability in a durably stable manner.

Figure 3:
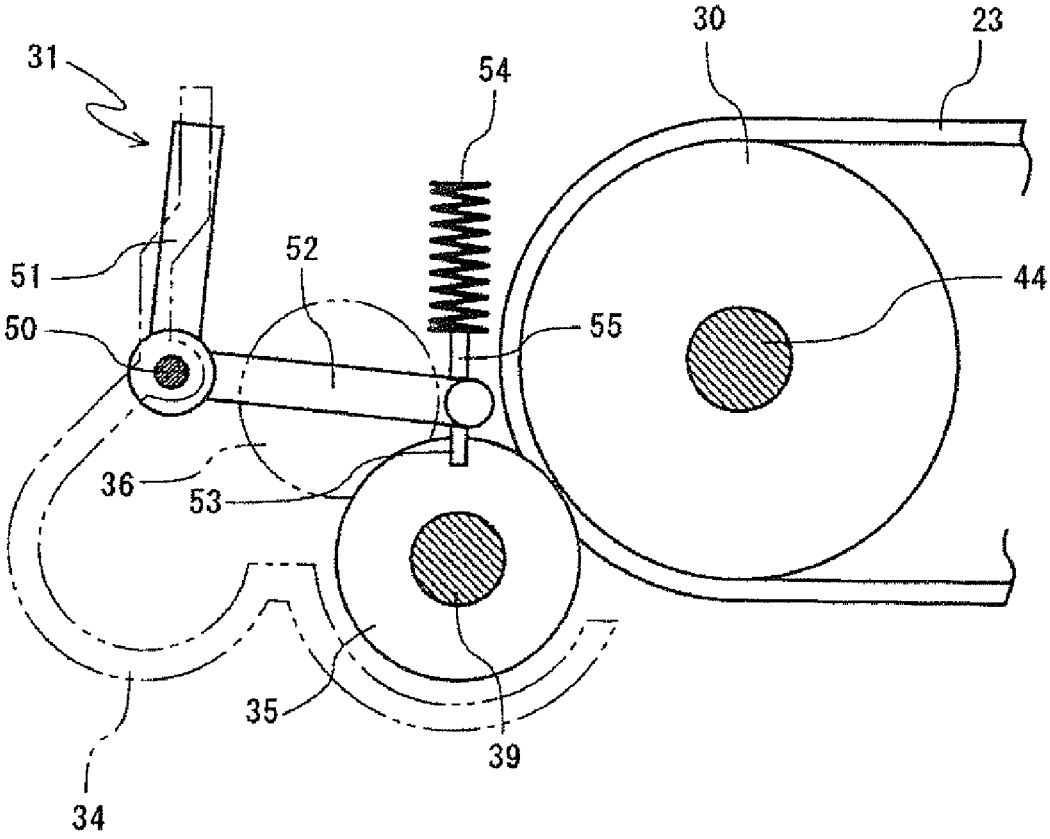
FIG. 3 illustrates a part of a cleaning device according to an embodiment, showing a state where a scraping member engages into a fur brush by a large amount.

In some embodiments, as shown in FIG. 2, scraping member 42 is provided in supporting member 41 that is provided as a combined configuration between the end of rotary shaft 39 of cleaning member 35 and the end of rotary shaft 40 of toner recovery roller 36. FIG. 3 illustrates an embodiment of scraping member 53 supported by cleaning case 34, like rotary shafts 39 and 40.

Figure 4:
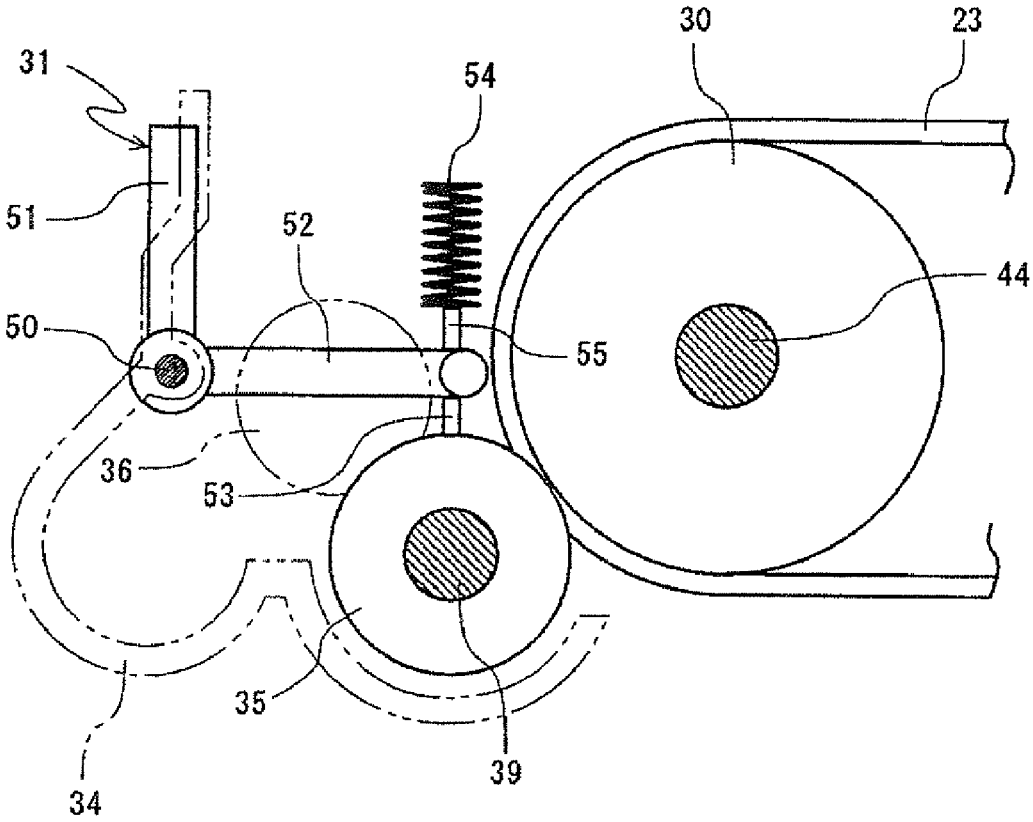
FIG. 4 illustrates a part of the cleaning device according to an embodiment, showing a state where the scraping member engages into the fur brush by a small amount.

FIGS. 3 and 4 illustrate an embodiment including a cleaning device 31. Specifically, FIG. 3 is a diagram showing a state where scraping member 53 engages into the fur brush by a large amount, whereas FIG. 4 is a diagram showing a state where scraping member 53 engages into the fur brush by a small amount.

Referring to FIGS. 3 and 4, opposite ends of support shaft 50 for driving arm 51 and driven arm 52 that allow scraping member 53 to be displaceable are fixed in cleaning case 34.

In some embodiments, support shaft 50 is provided with driving arm 51 coupled to a solenoid (not shown) and driven arm 52 extending upward of cleaning member 35.

Furthermore, an end of driven arm 52 is provided with scraping member 53 that is engageable into cleaning member 35, and spring 54 whose one end is supported by cleaning case 34 is provided at one side or each side of cleaning member 35 in the axial direction thereof. In some embodiments, member 55 receiving pressure from spring 54 coupled to driven arm 52 is integrated with scraping member 53 or is configured to hold scraping member 53. Member 55 may be formed of a various materials including but not limited to metallic materials, such as aluminum, stainless steel, SUS, iron, or other materials known in the art. In this configuration, the amount by which scraping member 53 engages into cleaning member 35 during an image formation mode is set equal to or greater than the amount by which toner recovery roller 36 engages into cleaning member 35, as shown in FIG. 3.

By causing scraping member 53 to engage into cleaning member 35 by a large amount, residual toner located further inward towards the center of axis and between the brush fibers of cleaning member 35 can be scraped off, thereby enhancing toner recovery performance.

In some embodiments, when not performing an image formation mode (e.g., a shutdown mode, an idling mode, or a calibration mode), the solenoid is driven so as to cause scraping member 53 to engage into cleaning member 35 by a small amount (including a non-contact state, that is, a state where the amount of engagement is zero), as shown in FIG. 4, thereby inhibiting and/or preventing the brush fibers of cleaning member 35 from flattening, as well as maintaining cleanability in a durably stable manner.

When a calibration mode, for example, is performed in a state where the amount of engagement is large, although the toner attached to intermediate transfer belt 23 is recovered by cleaning member 35 and is splattered towards the downstream side of scraping member 53 (i.e., the upstream side of the toner recovery roller 36), because the toner is electrically recovered by the toner recovery roller 36, a toner spillage towards the downstream side of the toner recovery roller 36 can be decreased.

Having thus described in detail embodiments of the present invention, it is to be understood that the present invention is not to be limited to particular details and/or embodiments set forth in the above description, as many apparent variations thereof are possible without departing from the spirit or scope of the present invention.

What is claimed is:

1. A cleaning device comprising:

a cleaning member that is configured to rotate so as to remove residual toner from an intermediate transfer belt looped between multiple rollers;

a toner recovery roller that is configured to electrically recover the toner from the cleaning member;

a scraping member that is configured to contact the cleaning member at a position that is disposed:

i. at a downstream side, in a rotating direction of the cleaning member, relative to a cleaning nip section where the intermediate transfer belt and the cleaning member are in contact with each other; and ii. at an upstream side, in the rotating direction of the cleaning member, relative to a recovery nip section where the cleaning member and the toner recovery roller are in contact with each other; and a supporting member that is configured to fix a relative position between the toner recovery roller and the cleaning member and support the scraping member.

2. The cleaning device according to claim 1, wherein the supporting member includes a mechanism that mechanically biases the scraping member against the cleaning member with a substantially fixed load and moves the scraping member in a direction away from the cleaning member if a load applied to the scraping member exceeds a threshold.

3. The cleaning device according to claim 1, wherein the supporting member includes a member configured to fix a relative position between the cleaning member and one of the multiple rollers between which the intermediate transfer belt is looped.

4. The cleaning device according to claim 1, wherein the cleaning member includes a fur brush.

5. The cleaning device according to claim 4, wherein the fur brush comprises conductive polyester resin, conductive nylon resin, or a combination of conductive polyester resin and conductive nylon resin.

6. The cleaning device according to claim 1, wherein the toner recovery roller comprises stainless steel, nickel-plated metal, or a combination of stainless steel and nickel-plated metal.

7. The cleaning device according to claim 1, wherein the scraping member has a shape of a rod or a plate.

8. A cleaning device comprising:

a cleaning member that is configured to rotate so as to remove residual toner from an intermediate transfer belt looped between multiple rollers;

a toner recovery roller that is configured to electrically recover the toner from the cleaning member; and a scraping member that is configured to contact the cleaning member at a position that is disposed:

i. at a downstream side, in a rotating direction of the cleaning member, relative to a cleaning nip section where the intermediate transfer belt and the cleaning member are in contact with each other; and ii. at an upstream side, in the rotating direction of the cleaning member, relative to a recovery nip section where the cleaning member and the toner recovery roller are in contact with each other, wherein the cleaning device is configured such that an amount by which the toner recovery roller engages into the cleaning member during image formation is substantially equal to or smaller than an amount by which the scraping member engages into the cleaning member.

9. A cleaning device comprising:

a cleaning member that is configured to rotate so as to remove residual toner from an intermediate transfer belt looped between multiple rollers;

a toner recovery roller that is configured to electrically recover the toner from the cleaning member;

a scraping member that is configured to contact the cleaning member at a position that is disposed:

i. at a downstream side, in a rotating direction of the cleaning member, relative to a cleaning nip section where the intermediate transfer belt and the cleaning member are in contact with each other; and ii. at an upstream side, in the rotating direction of the cleaning member, relative to a recovery nip section where the cleaning member and the toner recovery roller are in contact with each other; and a driving mechanism configured to move the scraping member so that an amount by which the scraping member engages into the cleaning member differs between an image formation mode and an image-formation stopped mode.

10. An image forming apparatus comprising:

an electrophotographic photosensitive body;

a charging unit that is configured to charge the electrophotographic photosensitive body;

an exposure unit that is configured to expose the electrophotographic photosensitive body charged by the charging unit to light so as to form an electrostatic latent image on the electrophotographic photosensitive body;

a developing unit that is configured to use a developer to develop the electrostatic latent image formed on the electrophotographic photosensitive body by the exposure unit so as to form a developer image on the electrophotographic photosensitive body;

an intermediate transfer belt looped between multiple rollers and onto which the developer image formed on the electrophotographic photosensitive body by the developing unit is primarily transferred;

a transfer unit that is configured to secondarily transfer the developer image primarily transferred on the intermediate transfer belt onto a predetermined recording medium;

a cleaning member that is configured to rotate so as to remove residual developer from the intermediate transfer belt;

a toner recovery roller that is configured to electrically recover the developer from the cleaning member; and a scraping member that is configured to contact the cleaning member at a position that is disposed:

i. at a downstream side, in a rotating direction of the cleaning member, relative to a cleaning nip section where the intermediate transfer belt and the cleaning member are in contact with each other; and ii. at an upstream side, in the rotating direction of the cleaning member, relative to a recovery nip section where the cleaning member and the toner recovery roller are in contact with each other, wherein the image forming apparatus is configured such that an amount by which the toner recovery roller engages into the cleaning member during image formation is substantially equal to or smaller than an amount by which the scraping member engages into the cleaning member.

11. The image forming apparatus according to claim 10, further comprising a driving mechanism configured to move the scraping member so that an amount by which the scraping member engages into the cleaning member differs between an image formation mode and an image-formation stopped mode.

12. The image forming apparatus according to claim 11, wherein the driving mechanism includes a solenoid.

13. The image forming apparatus according to claim 11, wherein the image-formation stopped mode is an idling mode or a calibration mode.

* * * * *